US010988273B2

(12) United States Patent
Liang et al.

(10) Patent No.: US 10,988,273 B2
(45) Date of Patent: Apr. 27, 2021

(54) VACUUM PACKAGING MACHINE

(71) Applicant: GUANGZHOU ARGION ELECTRIC APPLIANCE CO., LTD., Guangzhou (CN)

(72) Inventors: Guoqiang Liang, Guangzhou (CN); Xiujia Liu, Guangzhou (CN); Yuanchao Wu, Guangzhou (CN); Zhicun Yin, Guangzhou (CN)

(73) Assignee: GUANGZHOU ARGION ELECTRIC APPLIANCE CO., LTD., Guangzhou (CN)

( * ) Notice: Subject to any disclaimer, the term of this patent is extended or adjusted under 35 U.S.C. 154(b) by 0 days.

(21) Appl. No.: 16/645,459

(22) PCT Filed: Aug. 23, 2018

(86) PCT No.: PCT/CN2018/101944
§ 371 (c)(1),
(2) Date: Mar. 7, 2020

(87) PCT Pub. No.: WO2019/047721
PCT Pub. Date: Mar. 14, 2019

(65) Prior Publication Data

US 2020/0299014 A1 Sep. 24, 2020

(30) Foreign Application Priority Data

Sep. 7, 2017 (CN) ..... 201710803138.9

(51) Int. Cl.
*B65B 31/00* (2006.01)
*B65B 51/30* (2006.01)
*B65B 31/06* (2006.01)

(52) U.S. Cl.
CPC ..... *B65B 51/303* (2013.01); *B65B 31/06* (2013.01)

(58) Field of Classification Search
CPC ..... B65B 31/00; B65B 31/02; B65B 31/024; B65B 31/04; B65B 31/06; B65B 57/005; B65B 51/146
(Continued)

(56) References Cited

U.S. PATENT DOCUMENTS

2005/0029152 A1* 2/2005 Brakes ..... B65B 51/146 206/524.8
2013/0097967 A1* 4/2013 Picozza ..... B65B 31/00 53/408
2016/0047786 A1* 2/2016 Owens ..... A23L 3/0155 426/418

FOREIGN PATENT DOCUMENTS

CN 204236818 U 4/2015
CN 205602191 U 9/2016
(Continued)

*Primary Examiner* — Chelsea E Stinson
(74) *Attorney, Agent, or Firm* — Bayramoglu Law Offices LLC

(57) ABSTRACT

Provided is a vacuum packaging machine (100), comprising a machine body (1), a vacuum cover (2), a main controller (3), a sub-controller (4), a heat-sealing mechanism (5) and a vacuumizing mechanism (6), wherein a vacuum chamber (11) is provided in the machine body, the vacuum cover covers the machine body and corresponds to the position of the vacuum chamber; the main controller is provided on the machine body, the sub-controller is provided on the vacuum cover, and the main controller is in communication connection with the sub-controller; and the main controller is in communication connection with the heat-sealing mechanism and the vacuumizing mechanism, and functional keys (40) used for implementing vacuumizing and heat-sealing operations are provided on the sub-controller.

6 Claims, 4 Drawing Sheets

(58) Field of Classification Search
USPC ..... 53/79, 477, 510, 432, 403, 405, 408
See application file for complete search history.

(56) References Cited

FOREIGN PATENT DOCUMENTS

| | | | |
|---|---|---|---|
| CN | 106275577 | A | 1/2017 |
| CN | 206427328 | U | 8/2017 |
| CN | 206466259 | U | 9/2017 |
| CN | 107539524 | A | 1/2018 |

* cited by examiner

VACUUM PACKAGING MACHINE

CROSS REFERENCE TO RELATED APPLICATIONS

This application is the national phase entry of International Application PCT/CN2018/101944, filed on Aug. 23, 2018, which is based upon and claims priority to Chinese Patent Application No. 201710803138.9, filed on Sep. 7, 2017, the entire contents of which are incorporated herein by reference.

TECHNICAL FIELD

The invention relates to the technical field of packaging equipment, and in particular to a vacuum packaging machine.

BACKGROUND

As shown in FIG. 1, a current common (suction) vacuum packaging machine comprises a vacuum pump, a vacuum chamber, a vacuum cover 103, a solenoid valve, a heater, a heat-sealing strip, a lock structure 102, a controller 101, and a vacuum cover opening and closing unit. Such (suction) vacuum packaging machine comprises the following specific working process: first, opening the vacuum cover 103 and placing the bag mouth of a packaging bag 105 in the vacuum chamber; then closing the vacuum cover 103 and locking the lock structure 102; and finally, controlling the (suction) vacuum packaging machine by the controller 101 to complete an operation of vacuuming and heat-sealing the packaging bag. However, in a process of operating such (suction) vacuum packaging machine, before the vacuum cover 103 is closed, a user must use at least one hand to apply an external force in the left-right or front-rear direction to keep the bag mouth of the packaging bag 105 flat and stable in the vacuum chamber in order to ensure that the packaging bag 105 can achieve a good heat-sealing effect. After the vacuum cover 103 is closed, in order that the bag mouth of the packaging bag 105 remains flat and stable and the vacuum chamber is completely sealed before vacuumizing so that the vacuumizing unit can perform a vacuumizing operation to the vacuum chamber and the packaging bag, the user needs to lock two sides of the lock structure 102 with both hands while pressing down the vacuum cover by a hand, then click the control key on the controller 101 with a hand, and when the machine finishes the vacuumizing operation, the user unlocks the lock structure 102 by a hand. This operation process is complicated and tedious, and it is prone to the situation that the heat-sealing effect is not good and air leakage occurs since the bag mouth is not kept flat.

In order to overcome the technical problem of inconvenient operation of the lock structure, some (suction) vacuum packaging machines do not adopt lock structures or a manner of pressing the vacuum cover 103 with both hands to achieve the technical purpose of maintaining the bag mouth of the packaging bag flat and the vacuum chamber sealed. However, the controller 101 (and a control key) of such (suction) vacuum packaging machine is mostly provided on the machine body 104. Since the controller 101 (and a control key) is separated from the vacuum cover 103, the user still feels that the operation is inconvenient and the design is irrational. In other words, the existing (suction) vacuum packaging machines generally have technical problems of tedious operation and inconvenient use.

SUMMARY

In order to overcome the technical problems of tedious operation and inconvenient use in the existing vacuum packaging machines, the invention provides a vacuum packaging machine with simple operation and convenient use.

In order to achieve the aforementioned objectives, a vacuum packaging machine is provided in the invention, which comprises a machine body, a vacuum cover, a main controller, a sub-controller, a heat-sealing unit, and a vacuumizing unit;

a vacuum chamber is provided in the machine body, and the vacuum cover is covered on the machine body corresponding to a position of the vacuum chamber;

the main controller is provided on the machine body, the sub-controller is provided on the vacuum cover, and the main controller is in communication connection with the sub-controller; and the main controller is in communication connection with the heat-sealing unit and the vacuumizing unit, and the sub-controller is provided with a functional key unit used for implementing vacuumizing and heat-sealing operations.

In the aforementioned vacuum packaging machine, the sub-controller is provided with a first function key used for implementing the vacuuming and heat-sealing operations, and a second function key used for separately implementing heat-sealing operation.

In the aforementioned vacuum packaging machine, the vacuum cover is provided with a handle, the handle and the vacuum chamber are respectively located at two sides of the vacuum cover, and the sub-controller is provided on the handle.

In the aforementioned vacuum packaging machine, the heat-sealing unit comprises a heater and a heat-sealing strip; the heater is provided outside of the vacuum chamber, and the heat-sealing strip is provided on an inner side wall of the vacuum cover and corresponds to the heater.

In the aforementioned vacuum packaging machine, the vacuumizing unit comprises a vacuum pump, and an exhaust port provided on the machine body. The vacuum pump is in communication connection with the main controller, the exhaust port communicates with the vacuum chamber, and a suction port of the vacuum pump communicates with the exhaust port.

In the aforementioned vacuum packaging machine, an operation panel of the main controller is provided on an upper surface of the machine body.

In the aforementioned vacuum packaging machine, the vacuum cover is hinged to the machine body.

The invention has the following beneficial effects in comparison with the prior art:

Since the main controller and the sub-controller which are in communication connection with each other are provided, the main controller 3 is in communication connection with the heat-sealing unit and the vacuuming unit, and the sub-controller is provided on the vacuum cover and the sub-controller is provided with a function key unit, a user can use one hand to press the vacuum cover, simultaneously press down the vacuum cover to close the vacuum cover and click the function key unit on the sub-controller to complete the entire process of a required operation. The user's other hand can easily assist the operation to make the bag mouth of the packaging bag flat when the vacuum chamber is closed, thereby better ensuring a good heat-sealing effect. In other words, the vacuum packaging machine of the invention obviously has a simpler, more convenient and more effective operation when used than the existing vacuum packaging machines.

In the Figures: 100, a vacuum packaging machine; 1, a machine body; 11, a vacuum chamber; 2, a vacuum cover; 3, a main controller; 4, a sub-controller; 40, a function key unit; 41, a first function key; 42, a second function key; 5, a heat-sealing unit; 51, heater; 52, a heat-sealing strip; 6, a vacuumizing unit; 61, a vacuum pump; 62, an exhaust port; 7, a handle; 8, a packaging bag; and

101, a controller; 102, a lock structure; 103, a vacuum cover; 104, a vacuum chamber; 105, a packaging bag.

DETAILED DESCRIPTION OF THE EMBODIMENTS

The specific embodiments of the invention will be further described in detail below with reference to the accompanying drawings and embodiments. The following embodiments are used to illustrate the invention, but not to limit the scope of the invention.

Figure 1:
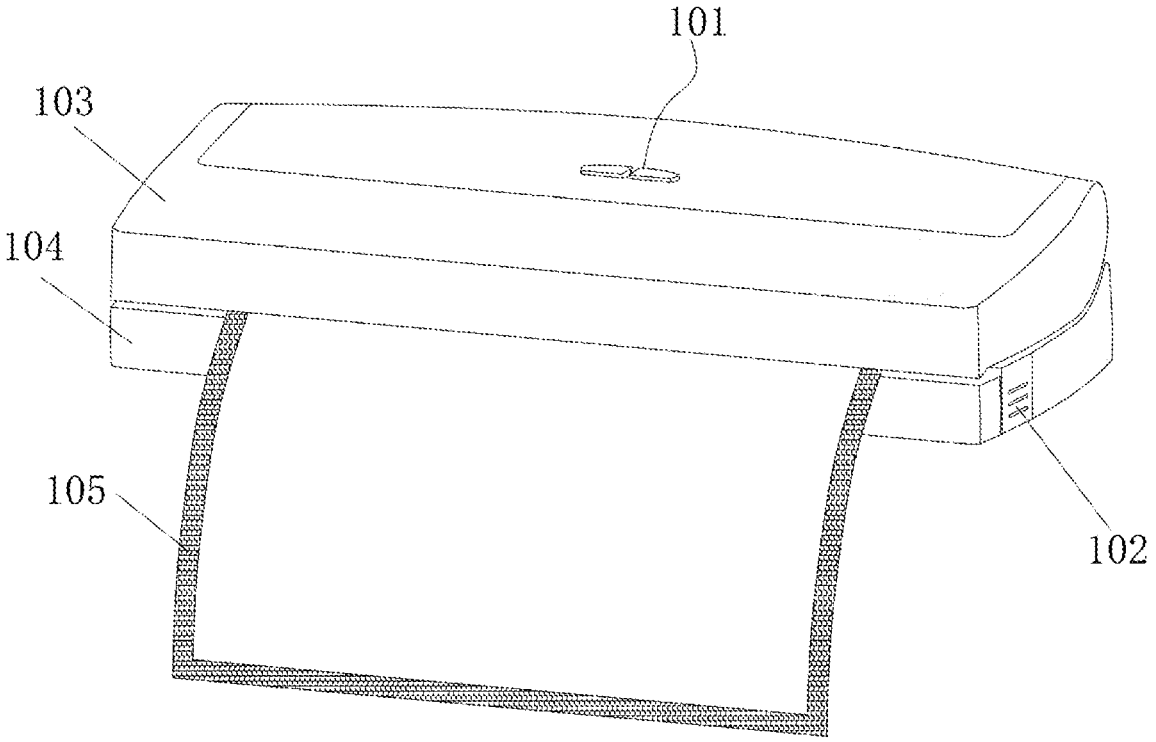
Figure 1 (Prior Art)
FIG. 1 is a schematic structural diagram of a vacuum packaging machine in the prior art.
Figure 2:
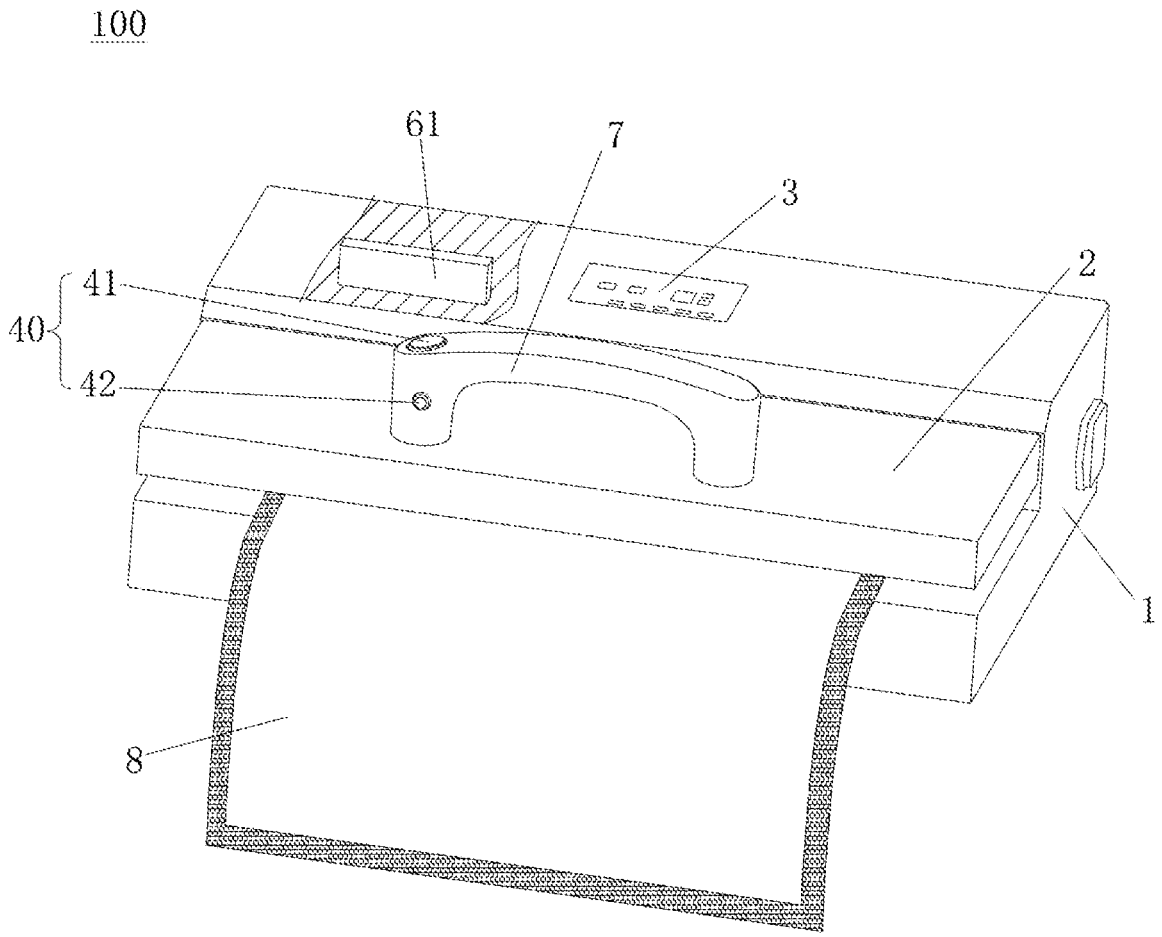
FIG. 2 is a first schematic structural diagram of a vacuum packaging machine according to an embodiment of the invention.
Figure 3:
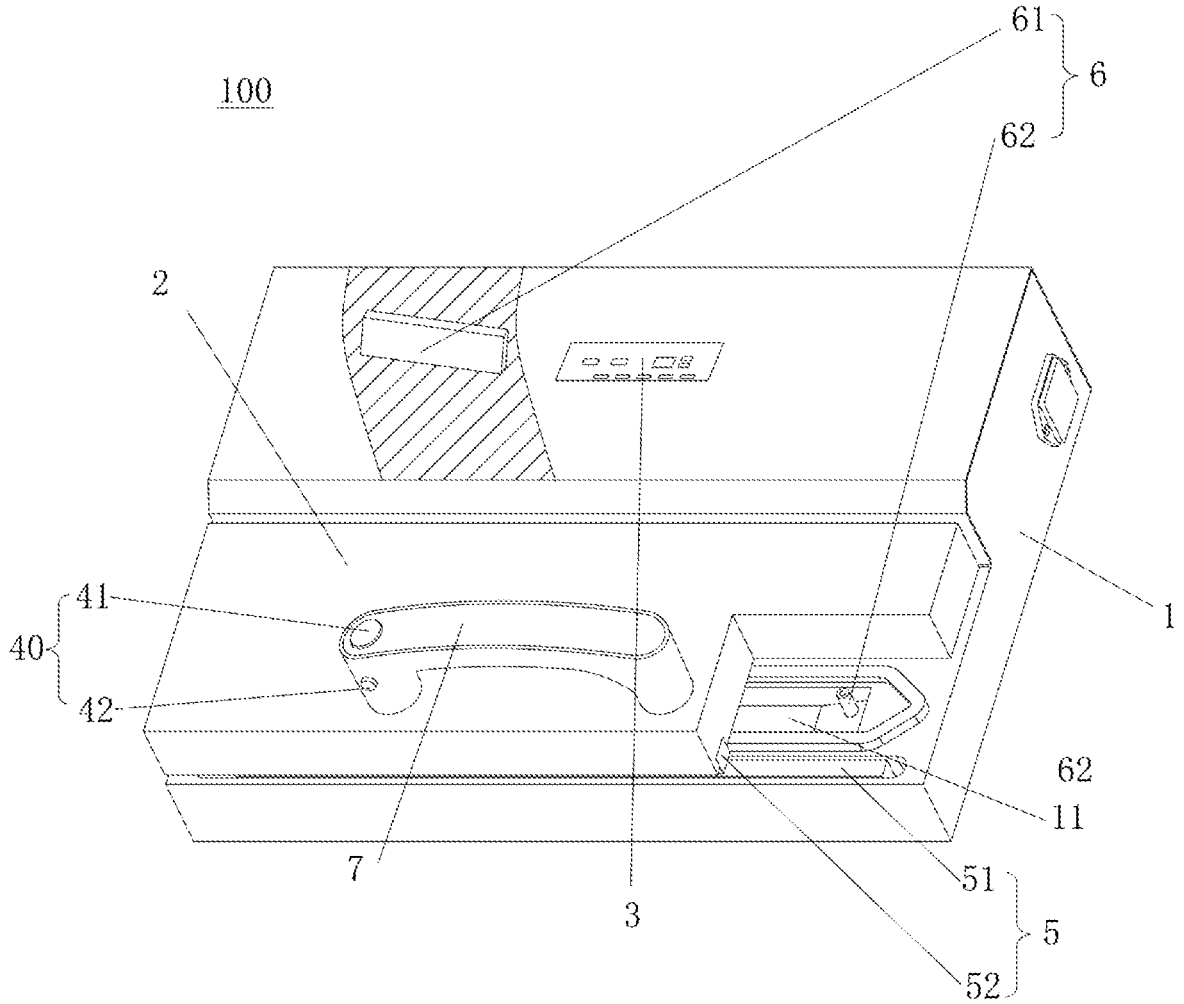
FIG. 3 is a second schematic structural diagram of a vacuum packaging machine according to an embodiment of the invention.
Figure 4:
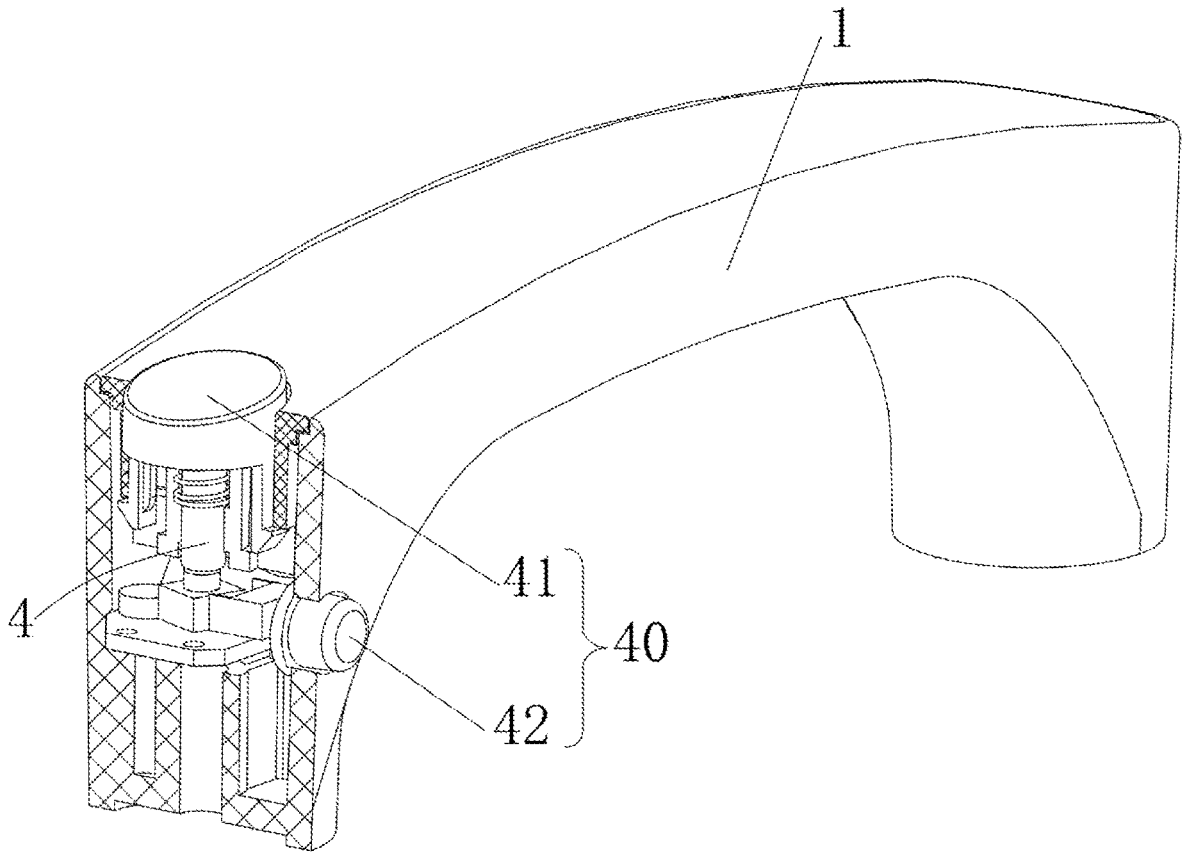
FIG. 4 is a schematic structural diagram of a handle of a vacuum packaging machine according to an embodiment of the invention.

Refer to FIGS. 2 to 4. A vacuum packaging machine 100 provided in the invention comprises a machine body 1, a vacuum cover 2, a main controller 3, a sub-controller 4, a heat-sealing unit 5, and a vacuumizing unit 6.

A vacuum chamber 11 is provided in the machine body 1, and the vacuum cover 2 is covered on the machine body 1 corresponding to a position of the vacuum chamber 11.

The main controller 3 is provided on the machine body 1, the sub-controller 4 is provided on the vacuum cover 2, and the main controller 3 is in communication connection with the sub-controller 4. According to use and/or design requirements, the main controller 3 and the sub-controller 4 may be in wired communication connection or wireless communication connection, so as to realize interaction of control signals and information between the sub-controller 4 and the main controller 3 on the main body of the vacuum packaging machine, and control and operation of the main controller 3 on corresponding mechanisms or components.

When the main controller 3 and the sub-controller 4 are in wired communication connection, wiring can be performed in the vacuum cover 2 and the sub-controller 4 on the vacuum cover 2 is connected to the main controller 3 on the machine body 1 through a traditional control circuit. When the vacuum cover 2 is transparent or in the case that wiring is not convenient, the main controller 3 and the sub-controller 4 can also be in wireless communication connection through, such as, infrared ray, Bluetooth, WiFi, GPRS/GSM/4G/LTE, or the like, to achieve convenient control of the vacuum packaging machine 100.

The main controller 3 is in communication connection with the heat-sealing unit 5 and the vacuumizing unit 6, and the sub-controller 4 is provided with a functional key unit 40 used for implementing vacuumizing and heat-sealing operations. According to functions to be implemented by the user pressing the function button unit 40, the sub-controller 4 generates corresponding control signals to the main controller 3. After receiving the control signals, the main controller 3 controls corresponding units or components (for example, the vacuuming unit 6, the heat-sealing unit 5) to perform the corresponding operations.

Since the main controller 3 and the sub-controller 4 which are in communication connection with each other are provided, the main controller 3 is in communication with the heat-sealing unit 5 and the vacuuming unit 6, and the sub-controller 4 is provided on the vacuum cover 2 and the sub-controller 4 is provided with a function key unit 40, a user can use one hand to press the vacuum cover 2, simultaneously press down the vacuum cover 2 to close the vacuum cover 2 and click the function key unit 40 on the sub-controller 4 to complete the entire process of a required operation. The user's other hand can easily assist the operation to make the bag mouth of the packaging bag 8 flat when the vacuum chamber 11 is closed, thereby better ensuring a good heat-sealing effect. In other words, the vacuum packaging machine 100 of the invention obviously has a simpler, more convenient and more effective operation when used than the existing vacuum packaging machines.

Refer to FIGS. 2 to 4. Preferably, the sub-controller 4 is provided with a first function key 41 used for implementing the vacuuming and heat-sealing operations, and a second function key 42 used for separately implementing the heat-sealing operation.

In the process of using the vacuum packaging machine 100 according to the embodiment of the invention, after the packaging bag 8 is placed in the vacuum chamber 11, the vacuum cover 2 is pressed to keep the bag mouth of the packaging bag 8 flat and stable in the vacuum chamber 11. In the process of pressing the vacuum cover 2, the vacuum cover 2 and the vacuum chamber 11 form a closed space.

If a user clicks the first function key 41, the sub-controller 4 will generate a control signal to the main controller 3. After receiving the control signal, the main controller 3 will first control the vacuumizing unit 6 to vacuumize the vacuum chamber 11, and then, according to the program set by the main controller 3, control the heat-sealing unit at a certain point in the vacuuming process to heat-seal the bag mouth of the packaging bag 8.

If the user clicks the second function key 42, the sub-controller 4 will generate another control signal to the main controller 3. After receiving the another control signal, the main controller 3 will follow the program set by the main controller 3 to control the heat-sealing unit 5 to start a heat-sealing process at a certain point in the vacuumizing process, or control the heat-sealing unit 5 to heat-seal the bag mouth of the packaging bag 8 under a non-vacuumizing condition.

Refer to FIGS. 2 to 4. Preferably, the vacuum cover 2 is provided with a handle 7. The handle 7 and the vacuum chamber 11 are located at two sides of the vacuum cover 2, and the sub-controller 4 is provided on the handle 7. Preferably, the first function key 41 is provided on an upper surface of the handle 7, and the second function key 42 is provided on a side surface of the handle 7.

Since the sub-controller 4 is provided on the handle 7, when the palm of one hand presses down the vacuum cover 2 and the bag mouth of the packaging bag 8 is kept flat and stable in the vacuum chamber 11, fingers of the one hand can also be used to operate the function key unit 40 on the sub-controller 4 to achieve one-handed operation. This effectively overcomes the technical problem of the existing vacuum packaging machines that one hand is needed to press the vacuum cover, one hand is needed to control the lock structure, one hand is needed to click the function key unit, and one hand is needed to stabilize the bag mouth, making it difficult for one person to complete operations.

Refer to FIGS. 2 to 4. The heat-sealing unit 5 comprises a heater 51 and a heat-sealing strip 52. The heater 51 is provided outside of the vacuum chamber 11, and the heat-sealing strip 52 is provided on an inner side wall of the vacuum cover 2 and corresponds to the heater 51.

Refer to FIGS. 2 to 4. The vacuumizing unit 6 comprises a vacuum pump 61, and an exhaust port 62 provided on the machine body 1. The vacuum pump 61 is in communication connection with the main controller 3, the exhaust port 62 communicates with the vacuum chamber 11, and a suction port of the vacuum pump 61 communicates with the exhaust port 62. Wherein, the suction port of the vacuum pump 61 can communicate with the exhaust port 62 through a gas-guide pipe, or the suction port 62 can directly communicate with the exhaust port 62 by properly arranging the position of the vacuum pump 61. An operation panel of the main controller 3 is provided on an upper surface of the machine body 1.

Preferably, the vacuum cover 2 is hinged to the machine body 1 so that the vacuum cover 2 can be easily opened and closed.

In conclusion, the vacuum packaging machine of the invention has the following beneficial effects in comparison with the prior art:

Since the main controller 3 and the sub-controller 4 which are in communication connection with each other are provided, the main controller 3 is in communication connection with the heat-sealing unit 5 and the vacuuming unit 6, and the sub-controller 4 is provided on the vacuum cover 2 and the sub-controller 4 is provided with a function key unit 40, a user can use one hand to press the vacuum cover 2, simultaneously press down the vacuum cover 2 to close the vacuum cover 2 and click the function key unit 40 on the sub-controller 4 to complete the entire process of a required operation. The user's other hand can easily assist the operation to make the bag mouth of the packaging bag 8 flat when the vacuum chamber 11 is closed, thereby better ensuring a good heat-sealing effect. In other words, the vacuum packaging machine 100 of the invention obviously has a simpler, more convenient and more effective operation when used than the existing vacuum packaging machines.

The above are only the preferred embodiments of the invention. It should be noted that, several improvements and replacements can be made by those skilled in the art without departing from the technical principles of the invention. These improvements and replacements also fall into the protection scope of the invention.

What is claimed is:

1. A vacuum packaging machine, wherein the vacuum packaging machine comprises a machine body, a vacuum cover, a main controller, a sub-controller, a heat-sealing unit, and a vacuumizing unit;

a vacuum chamber is provided in the machine body, and the vacuum cover covering on the machine body corresponding to a position of the vacuum chamber; the main controller is provided on the machine body, and the main controller is in communication connection with the sub-controller;

the main controller is in communication connection with the heat-sealing unit and the vacuumizing unit, and the sub-controller is provided with a functional key unit used for implementing vacuumizing and heat-sealing operations; and the vacuum cover is provided with a handle, the handle and the vacuum chamber are respectively located at two sides of the vacuum cover, and the sub-controller is provided on the handle.

2. The vacuum packaging machine according to claim 1, wherein the sub-controller is provided with a first function key used for implementing the vacuuming and heat-sealing operations, and a second function key used for separately implementing the heat-sealing operation.

3. The vacuum packaging machine according to claim 1, wherein the heat-sealing unit comprises a heater and a heat-sealing strip; the heater is provided outside of the vacuum chamber, and the heat-sealing strip is provided on an inner side wall of the vacuum cover corresponding to the heater.

4. The vacuum packaging machine according to claim 1, wherein the vacuumizing unit comprises a vacuum pump and an exhaust port provided on the machine body, the vacuum pump is in communication connection with the main controller, the exhaust port communicates with the vacuum chamber, and a suction port of the vacuum pump communicates with the exhaust port.

5. The vacuum packaging machine according to claim 1, wherein an operation panel of the main controller is provided on an upper surface of the machine body.

6. The vacuum packaging machine according to claim 1, wherein the vacuum cover is hinged to the machine body.

* * * * *